US009757752B2

(12) United States Patent
Kodama

(10) Patent No.: US 9,757,752 B2
(45) Date of Patent: Sep. 12, 2017

(54) DOUBLE-WALLED TUBE

(71) Applicant: Kao Corporation, Tokyo (JP)

(72) Inventor: Daisuke Kodama, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 15/044,374

(22) Filed: Feb. 16, 2016

(65) Prior Publication Data

US 2016/0256881 A1 Sep. 8, 2016

Related U.S. Application Data

(60) Provisional application No. 62/127,363, filed on Mar. 3, 2015, provisional application No. 62/127,882, filed on Mar. 4, 2015.

(51) Int. Cl.

| | |
|---|---|
| ***B65D 35/00*** | (2006.01) |
| ***B05B 11/04*** | (2006.01) |
| ***A45D 19/00*** | (2006.01) |
| ***B65D 35/04*** | (2006.01) |
| ***B65D 35/36*** | (2006.01) |
| ***B65D 35/14*** | (2006.01) |

(52) U.S. Cl.

CPC ..... *B05B 11/048* (2013.01); *A45D 19/0008* (2013.01); *B65D 35/04* (2013.01); *B65D 35/14* (2013.01); *B65D 35/36* (2013.01)

(58) Field of Classification Search

CPC ... A45D 19/0008; B05B 11/048; B65B 35/04; B65B 35/14; B65B 35/36

See application file for complete search history.

(56) References Cited

U.S. PATENT DOCUMENTS

| | | | | |
|---|---|---|---|---|
| 1,654,549 | A | 1/1928 | Mohun | |
| 2,564,359 | A | 8/1951 | Fuller | |
| 4,020,978 | A | 5/1977 | Szczepanski | |
| 7,059,501 | B2 * | 6/2006 | Masuda | B65D 35/14 222/212 |
| 2003/0015549 | A1 * | 1/2003 | Yoshida | B65D 35/14 222/103 |
| 2004/0188461 | A1 * | 9/2004 | Pennaneac'h | A45D 34/02 222/103 |
| 2010/0163581 | A1 * | 7/2010 | Vandromme | A45D 34/02 222/214 |
| 2016/0256881 | A1 * | 9/2016 | Kodama | A45D 19/0008 |

FOREIGN PATENT DOCUMENTS

| | | | |
|---|---|---|---|
| EP | 0579906 | A2 | 1/1994 |
| JP | H 03-256850 | A | 11/1991 |
| JP | 2003-072786 | A | 3/2003 |
| JP | 2013-193749 | A | 9/2013 |

* cited by examiner

*Primary Examiner* — Frederick C Nicolas
*Assistant Examiner* — Bob Zadeh
(74) *Attorney, Agent, or Firm* — Frost Brown Todd LLC

(57) ABSTRACT

A double-walled tube for dispensing product includes an inner wall, an outer wall positioned around the inner wall, and an opening defined by the inner wall. The inner wall and outer wall are flexible to dispense product held within the inner wall through the opening when the inner wall and outer wall are flexed.

17 Claims, 14 Drawing Sheets

DOUBLE-WALLED TUBE

This application is related to and claims priority from U.S. Provisional Patent Application No. 62/127,363, filed Mar. 3, 2015, and U.S. Provisional Patent Application No. 62/127,882, filed Mar. 4, 2015, both of which are incorporated herein by reference.

BACKGROUND

A product package that is squeezable to dispense product from the package, such as a tube, is known in the art. Such packages may be used to dispense a variety of products, including hair color, toothpaste, glue, gels, etc. In some instances, it is desirable for the package to be to able stand upright to prevent product from accidentally spilling from the package, or to aid the consumer in using the product (e.g., application of hair color). However, self-standing packages may be difficult to squeeze, thereby making it difficult to dispense product from the package. As such, there is a need for improved product packages that are both self-standing and easy for a user to squeeze.

BRIEF DESCRIPTION OF THE DRAWINGS

While the specification concludes with claims which particularly point out and distinctly claim the invention, it is believed the present invention will be better understood from the following description of certain embodiments taken in conjunction with the accompanying drawings, in which like reference numerals identify the same elements.

Figure 1:
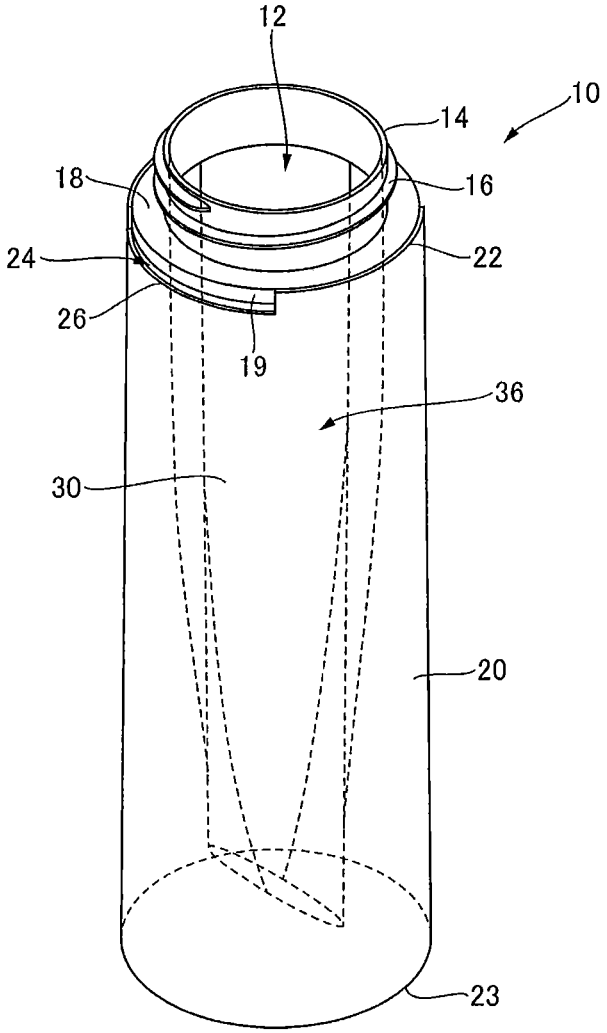
FIG. 1 depicts a top perspective view of an embodiment of a double-walled tube, showing an inner wall of the tube in broken lines.
Figure 2:
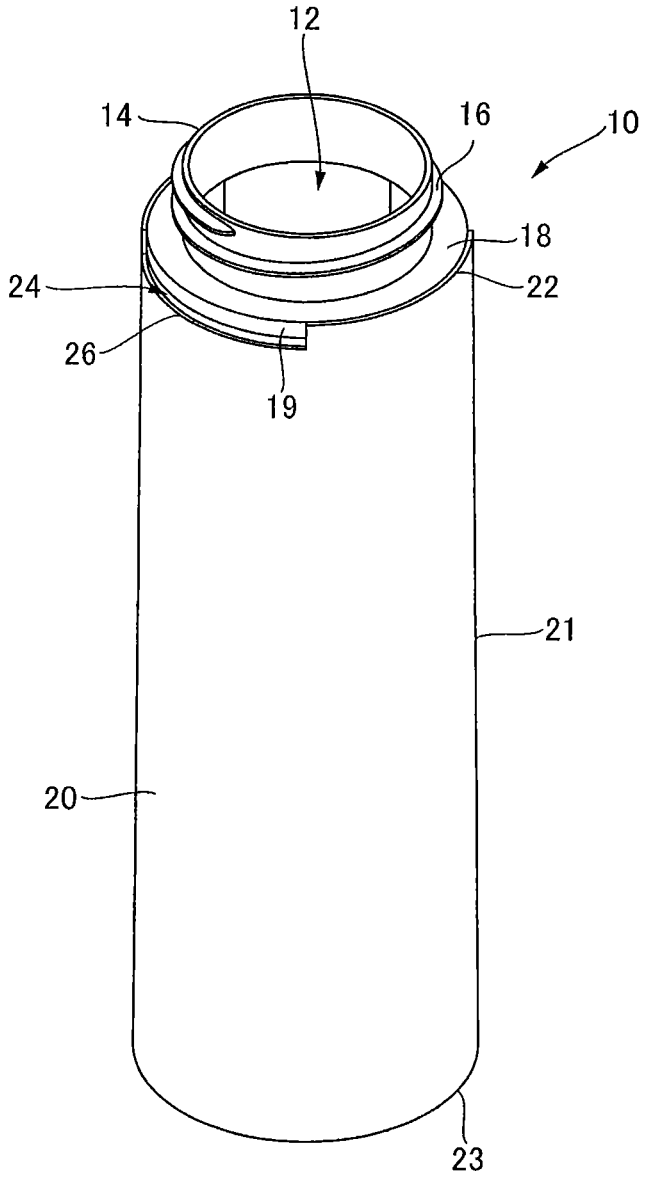
FIG. 2 depicts a top perspective view of the tube of FIG. 1.
Figure 3:
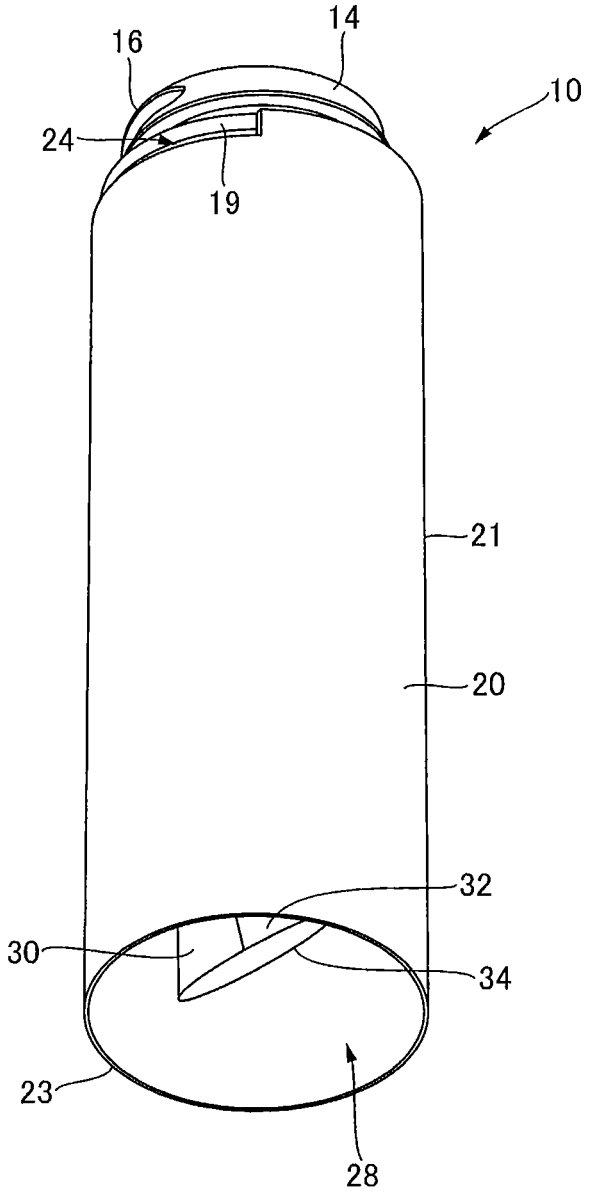
FIG. 3 depicts a bottom perspective view of the tube of FIG. 1.

The drawings are not intended to be limiting in any way, and it is contemplated that various embodiments of the invention may be carried out in a variety of other ways, including those not necessarily depicted in the drawings.

The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain embodiments of the present disclosure should not be used to limit the scope of the present disclosure. Other examples, features, aspects, embodiments, and advantages of the invention will become apparent to those skilled in the art from the following description. As will be realized, various aspects of the present disclosure may take alternate forms, or have alternate or additional embodiments, without departing from the scope of the present disclosure. Accordingly, the drawings and descriptions should be regarded as illustrative in nature and not restrictive.

FIG. 1 shows double-walled tube (10) comprising an outer wall (20), an inner wall (30), and a neck (14). Outer wall (20) is positioned around inner wall (30) such that outer wall (20) is connected to inner wall (30) by an annular ring (18). Neck (14) extends outwardly from annular ring (18) and defines an opening (12) extending through neck (14) and into an interior portion (36) of inner wall (30). Accordingly, interior portion (36) of inner wall (30) is configured to hold product, such as hair color, toothpaste, glue, gels, etc. In the present embodiment, both outer wall (20) and inner wall (30) are flexible. As will be discussed in more detail below, this allows the product to be dispensed from interior portion (36) of inner wall (30) by squeezing outer wall (20) toward inner wall (30), thereby squeezing inner wall (30) inwardly to dispense the product through opening (12). Of course, other suitable dispensing configurations will be known to a person with ordinary skill in the art in view of the teachings herein. For instance, outer wall (20) and/or inner wall (30) may be rigid or semi-rigid.

Opening (12) of neck (14) may be wide to allow product to be easily dispensed through opening (12). For example, the inner diameter of opening (12) may be between about 15 mm and about 70 mm, but other suitable diameters will be apparent to one with ordinary skill in the art in view of the teachings herein. Neck (14) further comprises threads (16) such that a cap and/or a pump (not shown) may be threadably coupled with tube (10) to prevent accidental spilling of the product through opening (12), or to enhance dispensing of the product.

In the present embodiment, tube (10) is injection molded as a single piece (a one piece construction). Tube (10) may be formed from polypropylene, polyethylene, thermoplastic elastomers, or other suitable materials that provide sufficient flexibility to allow tube (10) to compress to dispense the product from the interior portion of inner wall (30), while providing sufficient rigidity to allow tube (10) to stand erect. Inner wall (30) and/or outer wall (20) may be about 0.5 mm thick, but other suitable dimensions will be apparent to one with ordinary skill in the art in view of the teachings herein. For example, the thickness of inner wall (30) and/or outer wall (20) may depend on the properties, such as the flexibility, of the material from which the wall is made. Inner wall (30) and outer wall (20) may be injection molded using the same material, or inner wall (30) and outer wall (20) may be injection molded using different materials. For instance, inner wall (30) may comprise polypropylene, while outer wall (20) may comprise thermoplastic elastomers. Tube (10)

may further be formed from any suitable number of pieces that are injection molded separately and then secured together. Still other suitable methods for manufacturing tube (10) will be apparent to one with ordinary skill in the art in view of the teachings herein.

Figure 4:
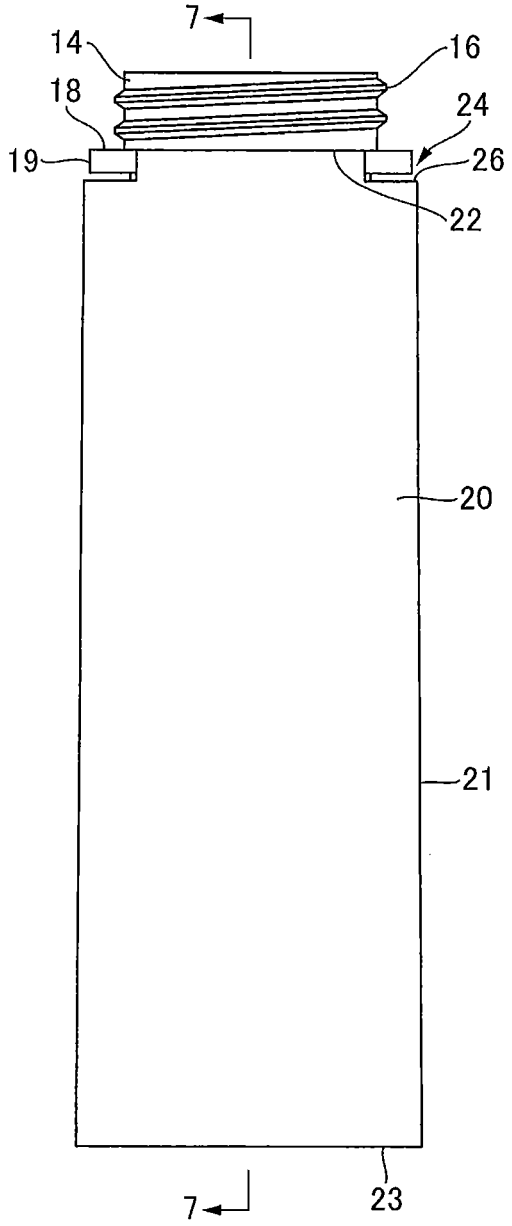
FIG. 4 depicts a side elevational view of the tube of FIG. 1.
Figure 5:
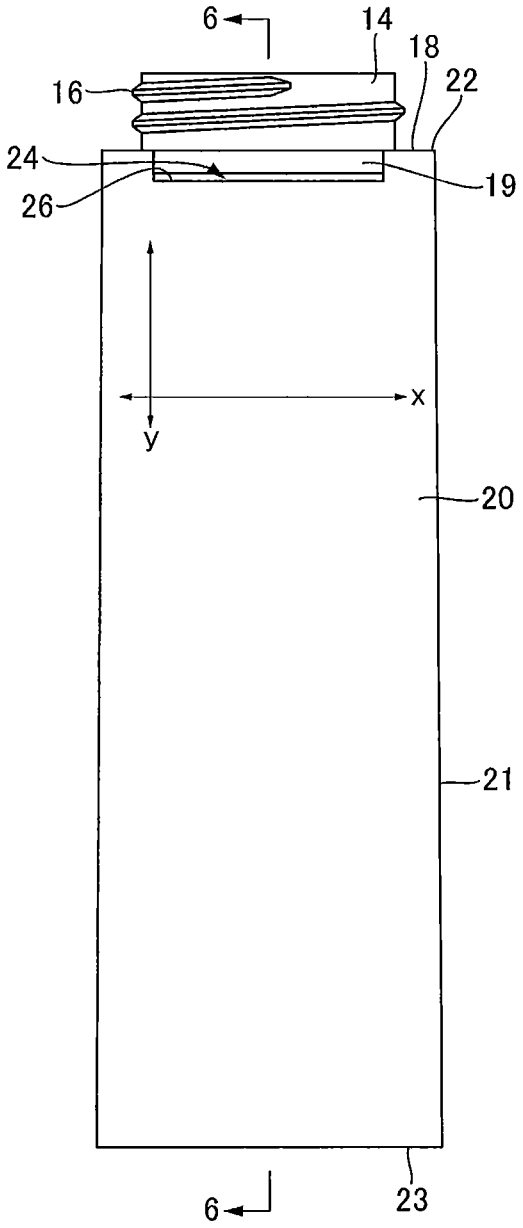
FIG. 5 depicts a front view of the tube of FIG. 1.

FIGS. 2-5 show outer wall (20) in more detail. Outer wall (20) comprises a side wall (21) that defines a bottom opening (28) extending from a bottom end (23) of outer wall (20) to a top portion (22) of outer wall (20). While side wall (21) is illustrated as being cylindrical, other suitable shapes may be used for tube (10), such as an oval (see FIGS. 12-13), square, rectangle, triangle, hexagon, octagon, etc., when viewed as a cross-section. Top portion (22) is coupled to a side wall (19) of annular ring (18) and comprises a pair of openings for deformation (24), located on outer wall (20) in a circumferential direction on opposing sides of outer wall (20), as best seen in FIGS. 4-5.

In the present embodiment, each opening for deformation (24) is rectangular and extends along about ¼ of the circumference of top portion (22) such that each opening for deformation (24) comprises a length/width ratio of greater than 5:1. The invention has at least one opening for deformation (24) and may have a plurality of openings for deformation (24). Other embodiments for openings for deformation (24) can include slits, recesses, holes, etc. Further, openings for deformation (24) can include any suitable shape, such as rectangular, multi-dimensional (exemplified in FIGS. 14 and 15), etc., that can be oriented in any suitable direction. More preferably the opening for deformation (24) is rectangular shaped. A multi-dimensional opening is an opening which has a different orientation along an x and y axis relative to the surface of the tube. For instance, if opening for deformation (24) comprises an arc-shape, the convex side of the arc-shape can be oriented upwardly toward top end portion (22) or downwardly toward bottom end (23). Additionally or alternatively, openings for deformation (24) can include a linear, wave, and/or zig-zag shape. Of course, other suitable configurations and/or amount of openings for deformation (24) will be apparent to one with ordinary skill in the art in view of the teachings herein. Openings for deformation (24) further extend within side wall (21) such that a top end (26) of each opening for deformation (24) is positioned below annular ring (18). Additionally the length/width ratio of the opening for deformation (24) can vary from a length/width ratio of less than one to a length/width ratio greater than one. Preferably the length/width ratio is greater that 5:1. In some embodiments, the opening for deformation (24) extends from 1/10 to ½ of the circumference of the top portion. More preferably the opening for deformation (24) extends along approximately ¼ of the circumference of the top portion (22). In another embodiment, the opening for deformation (24) extends from 1/10 to ½ of the circumference of the top portion. In the present embodiment, openings for deformation (24) are equidistant from top end (26) of outer wall (20). Accordingly, openings for deformation (24) allow top end (26) to flex inwardly below annular ring (18) when a top portion of outer wall (20) is squeezed, as will be discussed in more detail below.

Figure 6:
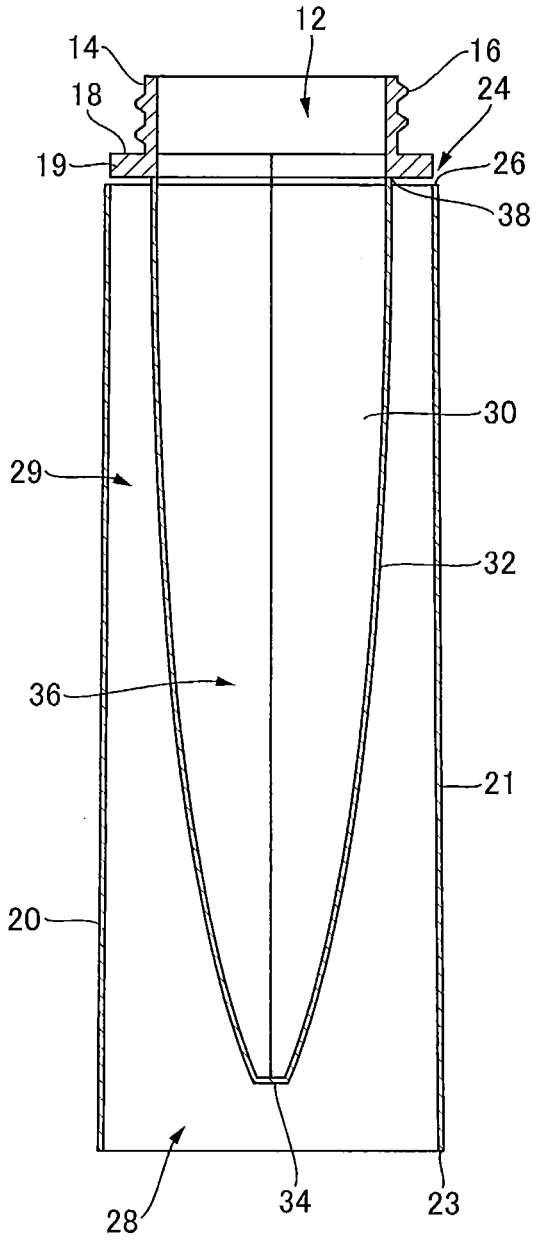
FIG. 6 depicts a side cross-sectional view of the tube of FIG. 1, taken along line 6-6 of FIG. 5.
Figure 7:
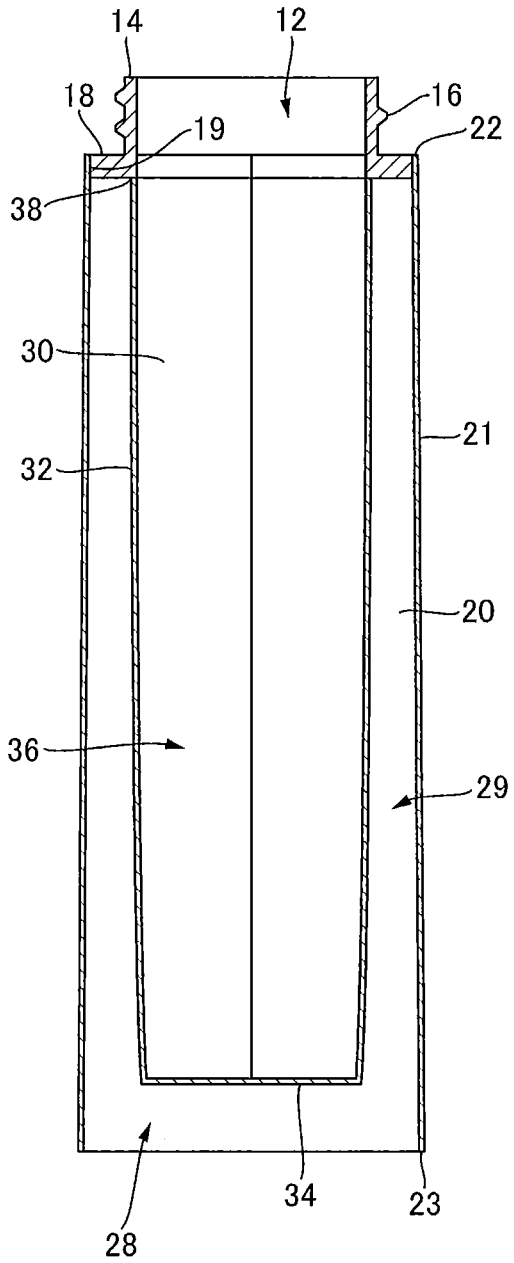
FIG. 7 depicts a front cross-sectional view of the tube of FIG. 1, taken along line 7-7 of FIG. 4.
Figure 8:
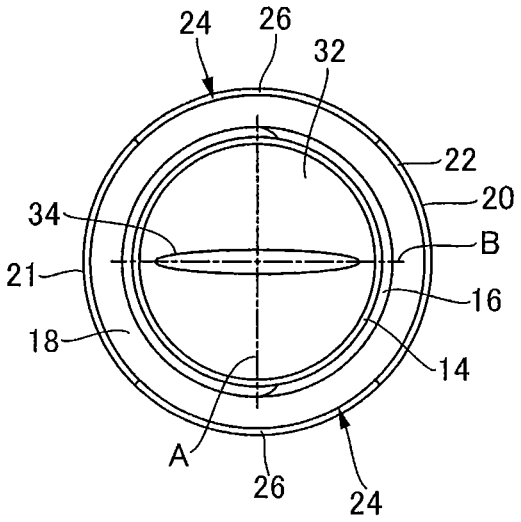
FIG. 8 depicts a top plan view of the tube of FIG. 1.
Figure 9:
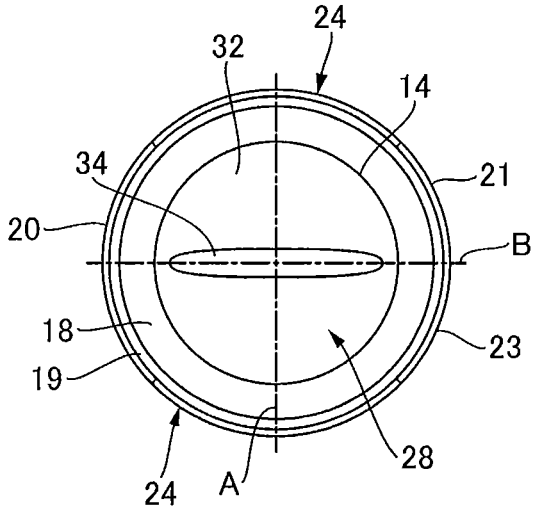
FIG. 9 depicts a bottom plan view of the tube of FIG. 1.

FIGS. 6-9 show inner wall (30) in more detail. Inner wall (30) comprises a side wall (32) having a top end (38) and a closed bottom end (34). As shown in FIG. 6, side wall (32) of inner wall (30) tapers inwardly as side wall (32) extends from top end (38) toward bottom end (34). Accordingly, side wall (32) forms a circular shape at top end (38) sized to correspond to and couple with annular ring (18) at opening (12). Side wall (32) then forms an oval shape at bottom end (34), as seen in FIGS. 8-9, such that side wall (32) is tapered more along a first axis (A) than side wall (32) is tapered along a second axis (B). Thus, opening (12) has a maximum cross-sectional area and closed bottom end (34) has a minimum cross-sectional area. The cross-sectional area of the portion of inner wall (30) between opening (12) and bottom end (34) is equal to or less than the maximum cross-sectional area of opening (12).

Bottom end (34) is closed such that inner wall (30) may hold product within interior portion (36). Bottom end (34) may be molded closed during the injection molding process, or bottom end (34) may be closed in a separate step. Because bottom end (34) is closed, the tapered configuration of inner wall (30) may allow inner wall (30) to be easily squeezed inwardly near the bottom portion of inner wall (30) to thereby dispense product out of interior portion (36) through opening (12). Of course, other configurations for inner wall (30) will be apparent to one with ordinary skill in the art in view of the teachings herein. For instance, inner wall (30) may be tapered to form other suitable shapes for bottom end (34) (e.g., a rectangle, a circle, a square, a hexagon, a point, etc.). Inner wall (30) may also only be tapered at a bottom portion of inner wall (30), along one axis (A, B), or inner wall (30) may not be tapered along either axis (A, B).

Bottom end (34) of the present embodiment is positioned centrally within outer wall (20) such that inner wall (30) and outer wall (20) are coaxial. FIGS. 8-9 show outer wall (20) defining first axis (A) and second axis (B) transverse to first axis (A) such that the second axis (B) crosses the first axis (A) at substantially the center of outer wall (20). Bottom end (34) of inner wall (30) is thereby positioned such that that the second axis (B) also crosses the first axis (A) at substantially the center of inner wall (30). Bottom end (34) is then oriented along the axes (A, B) such that bottom end (34) extends farther along the second axis (B) than bottom end (34) extends along the first axis (A). This aligns the wider sides of inner wall (30) with openings for deformation (24) of outer wall (20), but other orientations for inner wall (30) will be apparent to those with ordinary skill in the art in view of the teachings herein. For instance, bottom end (34) may be offset relative to the center of outer wall (20) and/or bottom end (34) may be rotated such that the wider side of inner wall (30) is not aligned with openings for deformation (24) of outer wall (20).

Referring back to FIGS. 6-7, an annular space (29) is defined between inner wall (30) and outer wall (20). Such a space (29) allows outer wall (20) to flex slightly inwardly before contacting inner wall (30), which may prevent inadvertent spilling of product held within inner wall (30). Accordingly, space (29) may prevent product from being dispensed if tube (10) is bumped, or a user grasps outer wall (20) to pick up and/or move tube (10). Also as seen in FIGS. 6-7, outer wall (20) extends beyond inner wall (30) such that outer wall (20) has a longer length than inner wall (30). This allows tube (10) to be self-standing by being supported on the wider bottom end (23) of outer wall (20). In the present embodiment, outer wall (20) is slightly tapered outwardly at bottom end (23) to provide additional support to tube (10). In other versions, outer wall (20) is not tapered and/or outer wall (20) is substantially the same length as inner wall (30). Still other suitable configurations for outer wall (20) will be apparent to one with ordinary skill in the art in view of the teachings herein.

Figure 10:
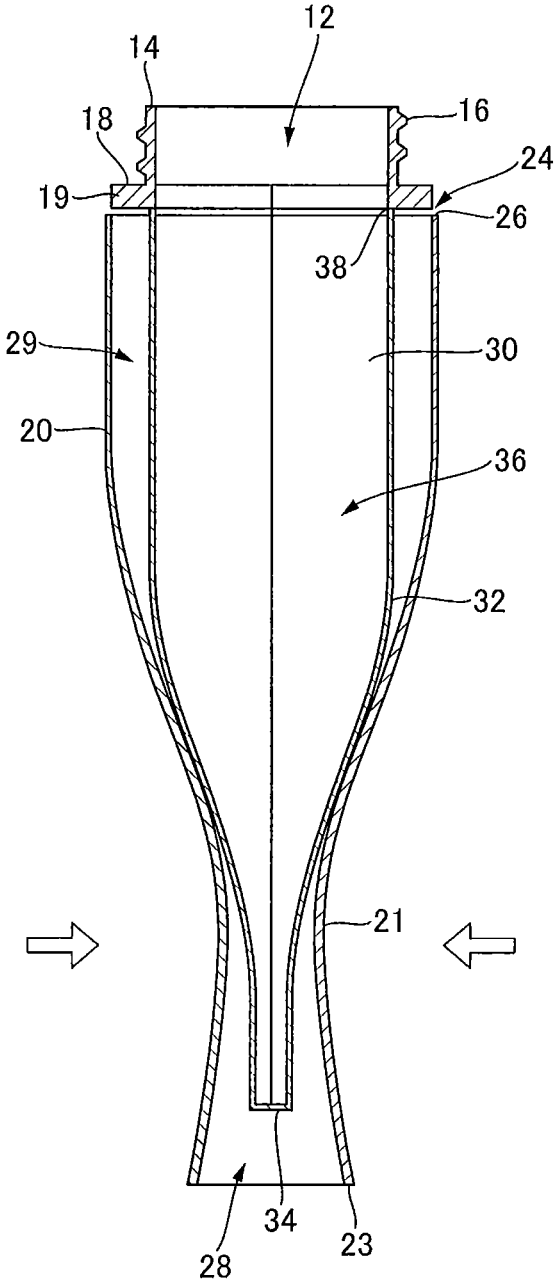
FIG. 10 depicts a side elevational view of the tube of FIG. 1, being squeezed at a bottom portion of the tube.

As described above, product may be held within inner portion (36) of inner wall (30). Outer wall (20) may then flex inwardly to contact inner wall (30) to thereby flex inner wall (30) inwardly and dispense product through opening (12) of tube (10). For instance, a user may grasp each side of outer wall (20) aligned with openings for deformation (24) and the wider sides of inner wall (30) to press side wall (21) of outer wall (20) towards side wall (32) of inner wall (30). As shown in FIG. 10, the bottom portion of outer wall (20) may be squeezed to thereby squeeze the bottom portion of inner wall (30) to push the product held within the bottom portion of inner wall (30) upwards within inner wall (30). A bottom opening (28) of outer wall (20) allows outer wall (20) to flex more easily at bottom end (23) of outer wall (20) and engage the bottom portion of inner wall (30). When the bottom portion of outer wall (20) is squeezed, outer wall (20) flexes to deform the bottom opening (28) from a substantially circular opening to an elliptical and/or peanut-shaped opening to allow outer wall (20) to contact inner wall (30). The tapered of configuration of inner wall (30) may also allow inner wall (30) to flex more easily at bottom end (34) of inner wall (30). Accordingly, side wall (32) may flex near bottom end (34) such that the opposing sides of side wall (32) contact each other to dispense substantially all of the product held within the bottom portion of inner wall (30).

Figure 11:
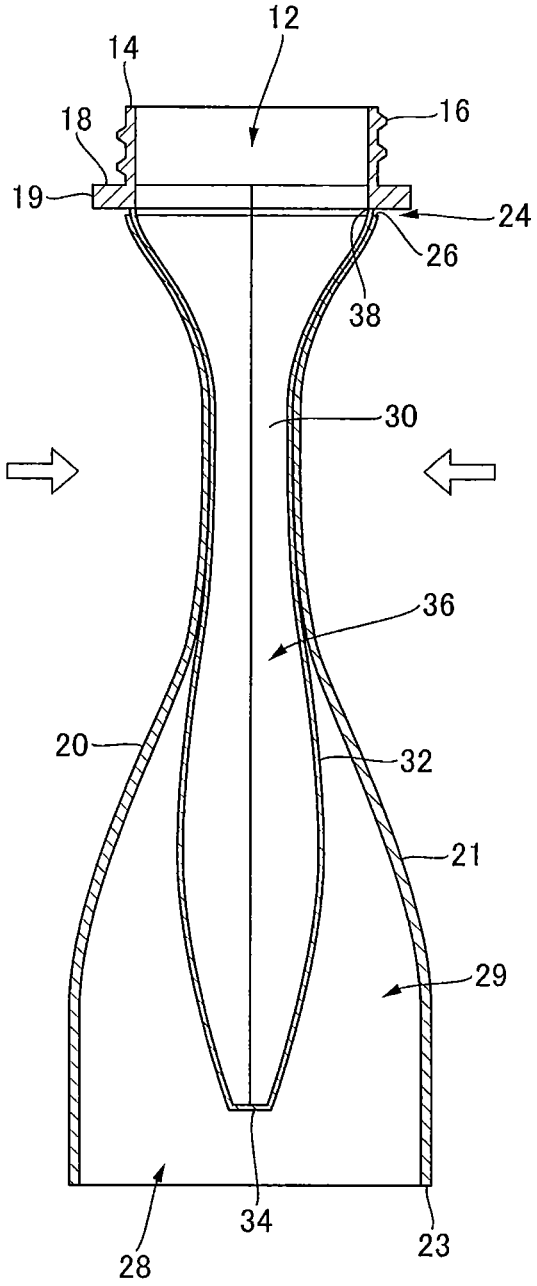
FIG. 11 depicts a side elevational view of the tube of FIG. 1, being squeezed at a top portion of the tube.

A user may then press outer wall (20) into inner wall (30) from the bottom portion of inner wall (30) to the top portion of inner wall (30) to dispense the product within through opening (12), as shown in FIG. 11. Openings for deformation (24) of outer wall (20) allow side wall (21) to flex inwardly underneath annular ring (18) and into opening (12). This may allow side wall (21) of outer wall (20) to press each side of side wall (32) of inner wall (30) into the opposing side of side wall (32) near top end (38) to dispense substantially all of the product through opening (12). In the present embodiment, once a user releases outer wall (20), both outer wall (20) and inner wall (30) return to their original shapes. In other versions, inner wall (30) and/or outer wall (20) may maintain the flexed shape and not return to the original shape. Other methods for dispensing product from tube (10) will be apparent to one with ordinary skill in the art in view of the teachings herein.

Figure 16:
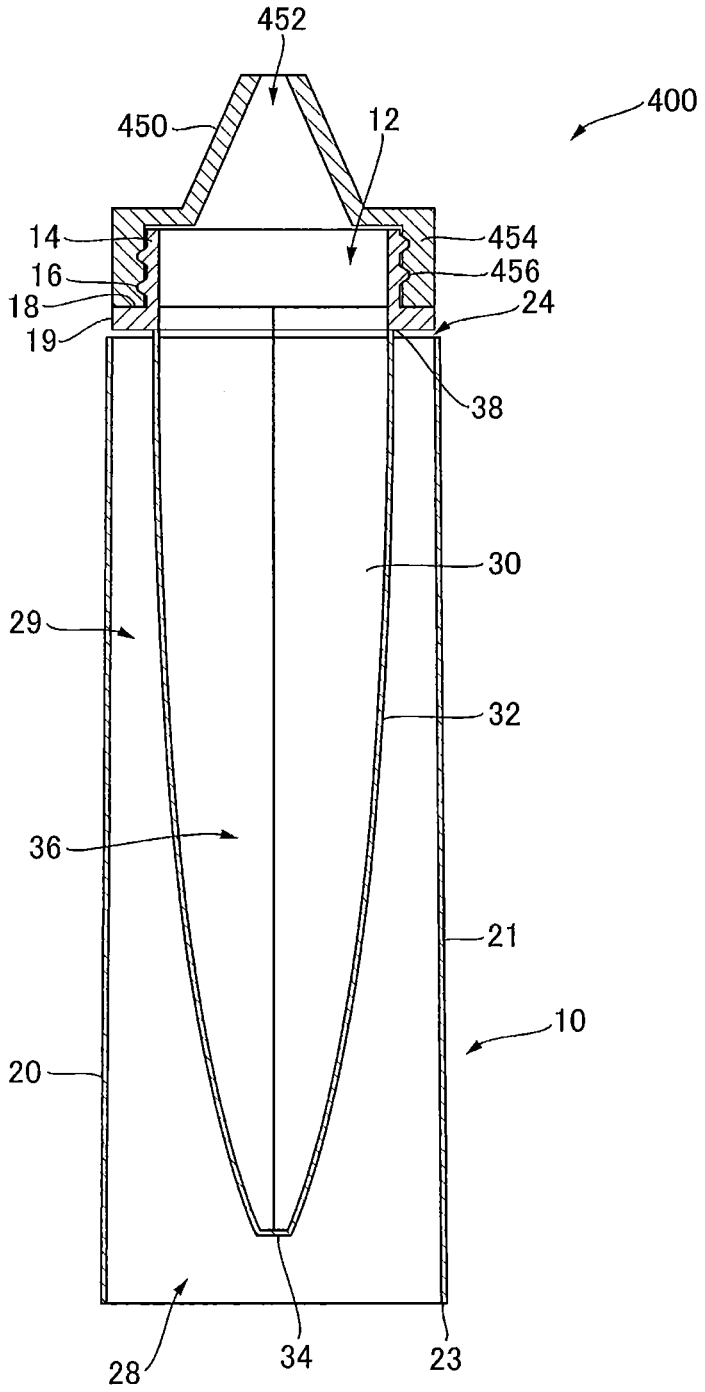
FIG. 16 depicts a side cross-sectional view of the tube of FIG. 1 with an applicator coupled with the tube.

Referring to FIG. 16, a container assembly (400) is shown having an applicator (450) that is selectively couplable with tube (10). In the present embodiment, applicator (450) defines an opening (452) that is aligned with opening (12) of tube (10) such that when product is dispensed through opening (12), the product is thereby dispensed from container assembly (400) through opening (452) of applicator (450). Although FIG. 16 shows applicator (450) having a conical shape, any other suitable shape for applicator (450) may be used. Applicator (450) further comprises an annular ring (454) having internal threads (456) that correspond to threads (16) of neck (14). Accordingly, applicator (450) may be rotated to thereby attach and/or remove applicator with neck (14) of tube (10). Other suitable configurations for selectively coupling applicator (450) with tube (10) will be apparent to one with ordinary skill in the art in view of the teachings herein. For instance, applicator (450) may be coupled with tube (10) via a snap fit or a friction fit.

Applicator (450) may be used with tube (10) to dispense a personal care product, such as for a hair colorant or other application to the hair. For instance, a first composition and a second composition may be mixed within interior portion (36) of tube (10) to form a hair colorant. Outer wall (20) may then be flexed inwardly to contact inner wall (30) to thereby flex inner wall (30) inwardly. This may cause the hair colorant to be dispensed through opening (12) of tube (10) and through opening (452) of applicator (450). As such, the hair colorant is dispensed from container assembly (400) via applicator (450).

Figure 12:
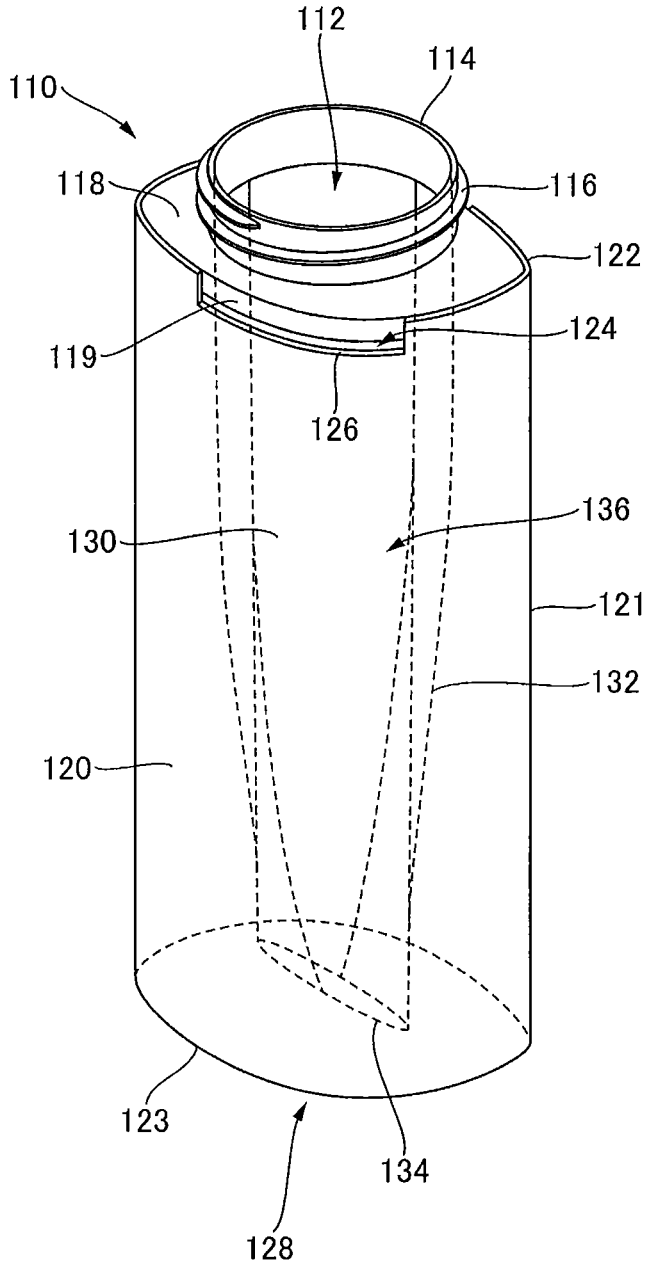
FIG. 12 depicts a top perspective view of another embodiment of a double-walled tube, showing an inner wall of the tube in broken lines.
Figure 13:
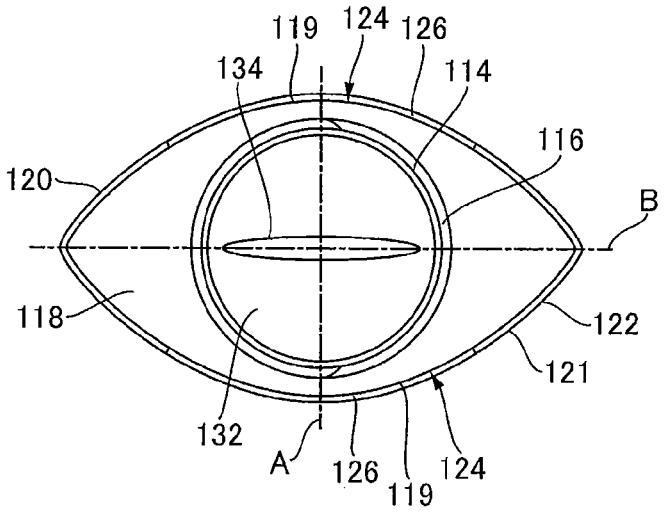
FIG. 13 depicts a top plan view of the tube of FIG. 12.

FIGS. 12-13 show an example of another double-walled tube (110) having an outer wall (120) positioned about an inner wall (130) that is similar to tube (10), except that outer wall (120) of tube (110) comprises an oval shape corresponding to inner wall (130). Accordingly, outer wall (120) extends further along second axis (B) than first axis (A), as shown in FIG. 13, similar to inner wall (130). Openings for deformation (124) of outer wall (120) of the present embodiment are aligned with the second axis (B) along the wider sides of outer wall (120) and inner wall (130). The oval shape of outer wall (120) may thereby indicate to a user to press the wider sides of outer wall (120) into the wider sides of inner wall (130) to more effectively dispense product through opening (112). For instance, the wider sides of the bottom portion of outer wall (120) may be squeezed to thereby squeeze the wider sides of the bottom portion of inner wall (130) to push the product held within the bottom portion of inner wall (130) upwards within inner wall (130). The wider sides of the top portion of outer wall (120) may then be squeezed such that openings for deformation (124) allow side wall (121) of outer wall (120) to flex inwardly underneath annular ring (118) to thereby squeeze the wider sides of the top portion of inner wall (130) to dispense product through opening (112).

Figure 14:
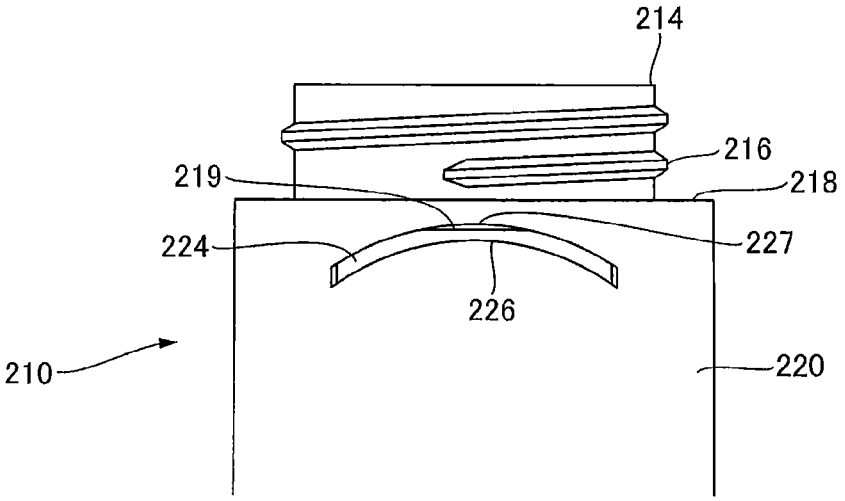
FIG. 14 depicts a front view of another embodiment of a double-walled tube, having a curved opening for deformation.

FIG. 14 shows an example of another double-walled tube (210) that is similar to tube (10), except that tube (210) comprises a curved opening for deformation (224). Opening for deformation (224) includes a top wall (227) and a bottom wall (226). Bottom wall (226) of opening for deformation (224) is positioned below annular ring (218) to allow bottom wall (226) to flex inwardly below annular ring (218) when a top portion of outer wall (220) is squeezed. Top wall (227) of opening for deformation (224) can be aligned with or positioned below annular ring (218). Still other suitable configurations for opening for deformation (226) will be apparent to one with ordinary skill in the art in view of the teachings herein.

Figure 15:
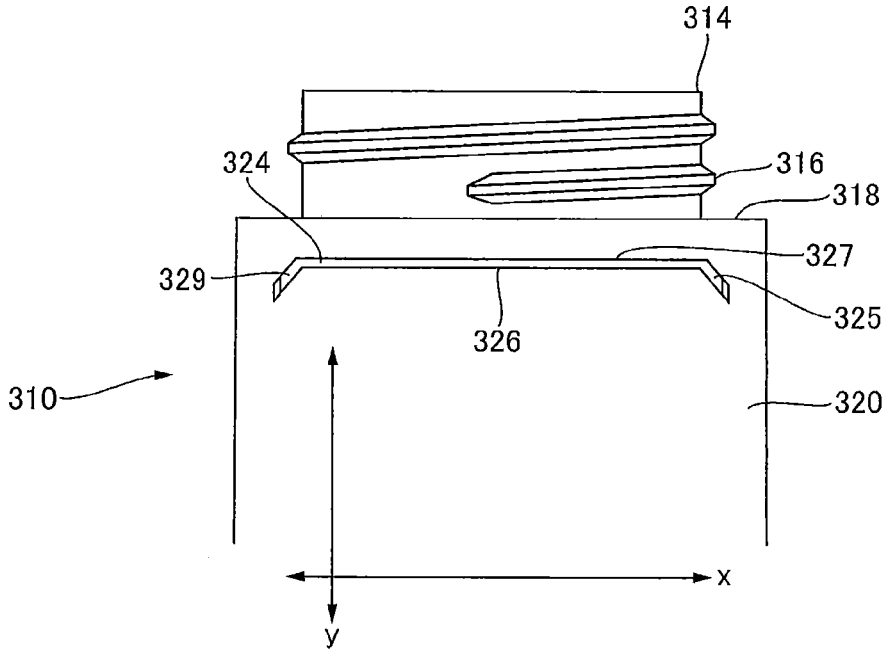
FIG. 15 depicts a front view of another embodiment of a double-walled tube, having a multi-dimensional opening for deformation.

FIG. 15 shows an example of another double-walled tube (310) that is similar to tube (10), except that tube (310) comprises a multi-dimensional opening for deformation (324). Multi-dimensional opening is referencing embodiments of the invention in which the opening for deformation comprises an opening characterized by both x- and y-axis (at least two dimensions) openings. Multi-dimensional opening for deformation (324) includes a rectangular opening having a top wall (327) and a bottom wall (326). Bottom wall (326) of opening for deformation (324) is positioned below annular ring (318) to allow bottom wall (326) to flex inwardly below annular ring (318) when a top portion of outer wall (320) is squeezed. Top wall (327) of opening for deformation (324) can be aligned with or positioned below annular ring (318). Opening for deformation further includes a pair of openings (325, 329) on each end of the rectangular opening that are angled downwardly relative to the rectangular opening. In the present embodiment, openings (325, 329) have a similar length and are oriented at similar opposing angles relative to the rectangular opening. In other embodiments, openings (325, 329) are oriented upwardly relative to the rectangular opening. In still other embodiments, openings (325, 329) have different lengths and/or are oriented at different angles relative to the rectangular opening. For instance, opening (325) may be oriented upwardly, while opening (329) may be oriented downwardly, or vice versa. Additional suitable configurations for openings (326, 325, 329) will be apparent to one with ordinary skill in the art in view of the teachings herein.

Additionally or alternatively, tubes (10, 110, 210, 310) may have dimples and/or other markings to indicate to the user where to press outer walls (20, 120, 220, 320) in order to engage the wider sides of inner walls (30, 130). Still other suitable marking configurations will be apparent to one with ordinary skill in the art in view of the teachings herein.

It should be understood that any one or more of the teachings, expressions, embodiments, examples, etc. disclosed herein may be combined with any one or more of the other teachings, expressions, embodiments, examples, etc. that are disclosed herein. The teachings, expressions, embodiments, examples, etc. disclosed herein should therefore not be viewed in isolation relative to each other. Various suitable ways in which numerous aspects of the present disclosure may be combined will be readily apparent to those of ordinary skill in the art in view of the teachings disclosed herein. Such modifications and variations are intended to be included within the scope of both the present disclosure and the claims.

Having shown and described various embodiments of the present disclosure, further adaptations of the methods and systems described herein may be accomplished by appropriate modifications by one of ordinary skill in the art without departing from the scope of the present disclosure. Several of such potential modifications have been mentioned, and others will be apparent to those skilled in the art. For instance, examples, embodiments, geometrics, materials, dimensions, ratios, steps, and the like discussed above are illustrative and are not required. Accordingly, the scope of the present disclosure should be considered in terms of the following claims and is understood not to be limited to the details of structure and operation shown and described in the specification and drawings.

What is claimed is:

1. A double-walled tube (10) for dispensing product comprising:

an inner wall (30) comprising a closed bottom end (34) and an interior portion (36) configured to hold the product; an outer wall (20) positioned around the inner wall (30); and an opening (12) defined by the interior portion (36) of the inner wall (30), wherein:

the outer wall (20) is flexible such that the outer wall (20) is configured to flex inwardly to contact the inner wall (30) and the inner wall (30) is flexible such that the inner wall (30) is configured to flex inwardly when the outer wall (20) contacts the inner wall (30);

the inner wall (30) is configured to dispense the product through the opening (12) when the inner wall (30) flexes inwardly;

the outer wall (20) is connected to the top portion of the inner wall (30);

the outer wall (20) comprises at least one opening for deformation (24) positioned at the top portion (22) of outer wall (20) to allow the outer wall (20) to flex inwardly at the top end (26) of the outer wall;

the outer wall (20) comprises a bottom opening (28) at the end opposite of the opening (12);

the outer wall (20) defines a space (29) between the outer wall (20) and the inner wall (30); and wherein the tube double-walled (10) is comprised of a one piece construction.

2. The double-walled tube (10) according to claim 1, wherein the opening for deformation (24) is located along outer wall (20) in a circumferential direction.

3. The double-walled tube (10) according to claim 1, wherein the opening (12) in the inner wall (30) has a maximum cross-sectional area and the closed bottom end (34) has a minimum cross-sectional area, wherein the cross-sectional area of the portion between the opening and the closed bottom end is equal to or less than the maximum cross-sectional area of the opening.

4. The double-walled tube (10) according to claim 1, wherein opening for deformation (24) is rectangular in shape.

5. The double-walled tube (10) according to claim 1, wherein opening for deformation (24) comprises a length/width ratio of greater than 5:1.

6. The double-walled tube (10) according to claim 1, wherein the opening for deformation (24) is curved.

7. The double-walled tube (10) according to claim 1, wherein the opening for deformation (24) is a multi-dimensional opening.

8. The double-walled tube (10) according to claim 1, wherein the outer wall (20) comprises a pair of openings for deformation (24), wherein each opening for deformation (24) is positioned on an opposing side of the outer wall (20).

9. The double-walled tube (10) according to claim 1, wherein the openings for deformation (24) are equidistant from top end (26) of outer wall (20).

10. The double-walled tube (10) according to claim 1, wherein the double-walled tube (10) is injection molded.

11. The double-walled tube (10) according to claim 1, wherein the double-walled tube (10) is self-standing.

12. The double-walled tube (10) according to claim 1, wherein the outer wall (20) has a longer length than the inner wall (30) such that the double-walled tube (10) is supported by the outer wall (30) when the double-walled tube (10) is standing.

13. The double-walled tube (10) according to claim 1, wherein the outer wall (20) is cylindrical.

14. The double-walled tube (10) according to claim 13, wherein the neck (14) further comprises threads (16).

15. The double-walled tube (10) according to claim 1, wherein the inner wall (30) comprises a neck (14) extending from the inner wall (30) about the opening (12).

16. A double-walled tube (10) for dispensing product comprising:

an inner wall (30) comprising a closed bottom end (34) and an interior portion (36) configured to hold the product; an outer wall (20) positioned around the inner wall (30); and an opening (12) defined by the interior portion (36) of the inner wall (30), wherein:

the outer wall (20) is flexible such that the outer wall (20) is configured to flex inwardly to contact the inner wall (30) and the inner wall (30) is flexible such that the inner wall (30) is configured to flex inwardly when the outer wall (20) contacts the inner wall (30);

the inner wall (30) is configured to dispense the product through the opening (12) when the inner wall (30) flexes inwardly;

the opening (12) in the inner wall (30) has a maximum cross-sectional area and the closed bottom end (34) has a minimum cross-sectional area, wherein the cross-sectional area of the portion between the opening and the closed bottom end is equal to or less than the maximum cross-sectional area of the opening;

the outer wall (20) is connected to the top portion of the inner wall (30);

the outer wall (20) comprises a bottom opening (28) at the end opposite of the opening (12);

the outer wall (20) defines a space (29) between the outer wall (20) and the inner wall (30); and wherein the double-walled tube (10) is comprised of a one piece construction.

17. A container assembly (400) for dispensing product comprising:

a double-walled tube (10), wherein the double-walled tube (10) comprises:

an inner wall (30) comprising a closed bottom end (34) and an interior portion (36) configured to hold the product, an outer wall (20) positioned around the inner wall (30), and an opening (12) defined by the interior portion (36) of the inner wall (30), wherein:

the outer wall (20) is flexible such that the outer wall (20) is configured to flex inwardly to contact the inner wall (30) and the inner wall (30) is flexible such that the inner wall (30) is configured to flex inwardly when the outer wall (20) contacts the inner wall (30), the inner wall (30) is configured to dispense the product through the opening (12) when the inner wall (30) flexes inwardly, the outer wall (20) is connected to the top portion of the inner wall (30), the outer wall (20) comprises at least one opening for deformation (24) positioned circumferentially at the top portion (22) of outer wall (20) to allow the outer wall (20) to flex inwardly at the top end (26) of the outer wall, the outer wall (20) comprises a bottom opening (28) at the end opposite of the opening (12), the outer wall (20) defines a space (29) between the outer wall (20) and the inner wall (30); and an applicator (450) selectively couplable with the double-walled tube (10), wherein the applicator (450) comprises an opening (452) aligned with the opening (12) of the double-walled tube (10) such that the product is dispensed from the container assembly (400) through opening (452) of the applicator (450).

* * * * *